US009543643B2

(12) United States Patent
Hayakawa et al.

(10) Patent No.: US 9,543,643 B2
(45) Date of Patent: Jan. 10, 2017

(54) ANTENNA DEVICE AND RADAR DEVICE

(71) Applicants: FUJITSU TEN LIMITED, Kobe-shi, Hyogo (JP); NIPPON PILLAR PACKING CO., LTD., Osaka-shi, Osaka (JP)

(72) Inventors: Eisuke Hayakawa, Kobe (JP); Takeshi Okunaga, Oasaki (JP); Akira Nakatsu, Osaka (JP)

(73) Assignees: FUJITSU TEN LIMITED, Kobe (JP); NIPPON PILLAR PACKING CO., LTD, Osaka (JP)

( * ) Notice: Subject to any disclaimer, the term of this patent is extended or adjusted under 35 U.S.C. 154(b) by 328 days.

(21) Appl. No.: 14/133,065

(22) Filed: Dec. 18, 2013

(65) Prior Publication Data

US 2014/0292606 A1 Oct. 2, 2014

(30) Foreign Application Priority Data

Mar. 29, 2013 (JP) ..... 2013-073403

(51) Int. Cl.

| | |
|---|---|
| ***H01Q 1/52*** | (2006.01) |
| ***H01Q 1/32*** | (2006.01) |
| ***H01Q 1/38*** | (2006.01) |
| ***H01Q 13/20*** | (2006.01) |

(52) U.S. Cl.

CPC ..... *H01Q 1/523* (2013.01); *H01Q 1/3233* (2013.01); *H01Q 1/38* (2013.01); *H01Q 13/206* (2013.01)

(58) Field of Classification Search

CPC ..... H01Q 1/523; H01Q 1/38

See application file for complete search history.

(56) References Cited

U.S. PATENT DOCUMENTS

| | | | | |
|---|---|---|---|---|
| 2003/0024633 | A1 | 2/2003 | Ogura et al. | |
| 2007/0159380 | A1 * | 7/2007 | Nagaishi | H01Q 1/38 342/70 |
| 2009/0153433 | A1 | 6/2009 | Nagai et al. | |

FOREIGN PATENT DOCUMENTS

| | | | |
|---|---|---|---|
| CN | 1264188 | A | 8/2000 |
| CN | 1462088 | A | 12/2003 |
| CN | 201845871 | U | 5/2011 |

(Continued)

OTHER PUBLICATIONS

Nov. 27, 2015 Office Action issued in Chinese Patent Application No. 201410074793.1.

(Continued)

*Primary Examiner* — Hoang V Nguyen
*Assistant Examiner* — Michael Bouizza
(74) *Attorney, Agent, or Firm* — Oliff PLC

(57) ABSTRACT

An antenna device according to an embodiment includes a dielectric substrate, a housing, and an interference prevention unit. On the top surface side of the dielectric substrate, a plurality of antennas is formed, and on the bottom surface side, a ground is formed, each as a conductive thin film pattern, respectively. The housing is formed of a conductive material, and formed to have a shape configured to function as a waveguide, and the top surface side of the housing is bonded to the bottom surface side of the dielectric substrate. The interference prevention unit is formed between the neighboring antennas to include at least a groove provided on the top surface side of the housing and a slit provided on the ground in the portion corresponding to the groove.

18 Claims, 11 Drawing Sheets

(56) References Cited

FOREIGN PATENT DOCUMENTS

| | | | | | |
|---|---|---|---|---|---|
| CN | 102594379 | A | | 7/2012 | |
| CN | 102611469 | A | | 7/2012 | |
| JP | A-08-167812 | | | 6/1996 | |
| JP | 2011239258 | A | * | 11/2011 | ..... H01Q 21/08 |

OTHER PUBLICATIONS

May 4, 2016 Office Action issued in German Patent Application No. 10 2014 203 185.0.
Aug. 16, 2016 Office Action issued in Chinese Patent Application No. 2014-10074793.1.

* cited by examiner

ANTENNA DEVICE AND RADAR DEVICE

CROSS-REFERENCE TO RELATED APPLICATIONS

This application is based upon and claims the benefit of priority of the prior Japanese Patent Application No. 2013-073403, filed on Mar. 29, 2013, the entire contents of which are incorporated herein by reference.

BACKGROUND OF THE INVENTION

1. Field of the Invention

The disclosed embodiment relates to an antenna device and a radar device.

2. Description of the Related Art

Conventionally, an antenna device in which a plurality of microstrip antennas each configured with a set of radiating elements arranged in series on a feedline is arranged in parallel on a surface of a dielectric substrate is known (e.g., Japanese Patent Application Laid-open No. 8-167812).

Such antenna device is installed, for example, in an onboard radar device for a vehicle and used, for example, for a vehicle following function in which a vehicle running ahead of, and on the same lane as, the own vehicle is detected as a target and the own vehicle follows the vehicle running ahead.

Specifically, the antenna device disclosed in Japanese Patent Application Laid-open No. 8-167812 is equipped with an insulation plate layered on a portion of the dielectric substrate on which the feedline is formed so as to insulate the feedline from the space. Thereby, unwanted radiation of radio wave from the feedline and a feeder circuit including a radiating element is restrained.

However, there is still a room for improvement in the prior art described above to prevent a radio wave interference occurring between neighboring microstrip antennas.

For example, it is known that the radio wave propagates not only in a space but also in the dielectric substrate, an adhesive sheet for bonding the dielectric substrate to a housing which acts as a waveguide, or the like. Therefore, the prior art described above is insufficient for restraining such propagation and preventing radio wave interference.

The radio wave interference can be prevented by lengthening the distance between the neighboring microstrip antennas. However, the lengthening is not preferable because the device may fail to satisfy the required level of performance, and the space for arrangement become large.

SUMMARY OF THE INVENTION

It is an object of the present invention to at least partially solve the problems in the conventional technology.

An antenna device according to an aspect of an embodiment includes a dielectric substrate, a housing, and an interference prevention unit. On the top surface side of the dielectric substrate, a plurality of antennas is formed, and on the bottom surface side, a ground is formed, each as a conductive thin film pattern, respectively. The housing is formed of a conductive material, and formed to have a shape configured to function as a waveguide, and the top surface side of the housing is bonded to the bottom surface side of the dielectric substrate. The interference prevention unit is formed between the neighboring antennas to include at least a groove provided on the top surface side of the housing and a slit provided on the ground in the portion corresponding to the groove.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

An embodiment of an antenna device and a radar device disclosed herein will be described below in detail referring to the attached drawings. The present invention is not limited to the embodiment described below.

An outline of a radio wave interference prevention technique according to the embodiment will be described below using FIG. 1A and FIG. 1B, and then, an antenna device and a radar device to which the radio wave interference prevention technique is applied will be described using FIG. 2 to FIG. 10B. a first embodiment will be explained in FIG. 2 to FIG. 8, a second embodiment will be described in FIG. 9A to FIG. 9C, and a third embodiment will be described in FIG. 10A and FIG. 10B.

The antenna is considered to be a microstrip antenna in the following description.

Figure 1A:
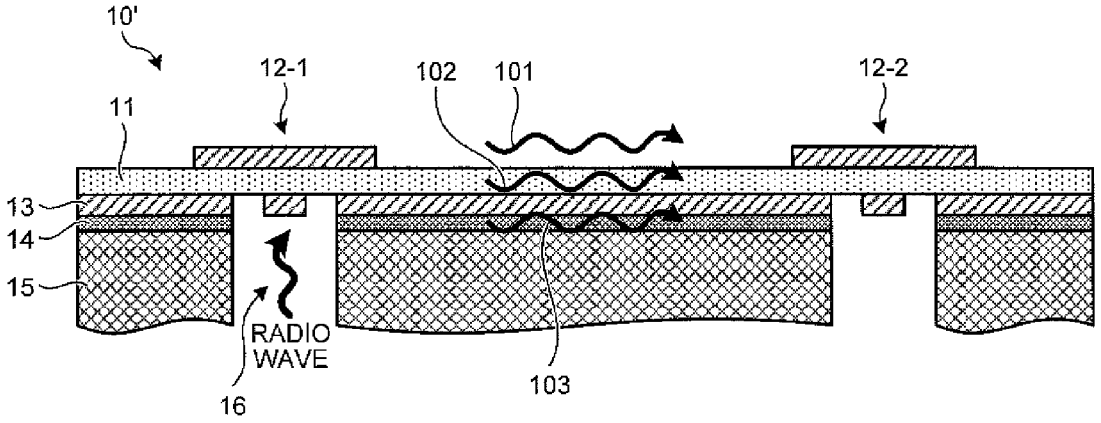
FIG. 1A is a rough schematic cross sectional view of an antenna device according to the prior art.
Figure 1B:
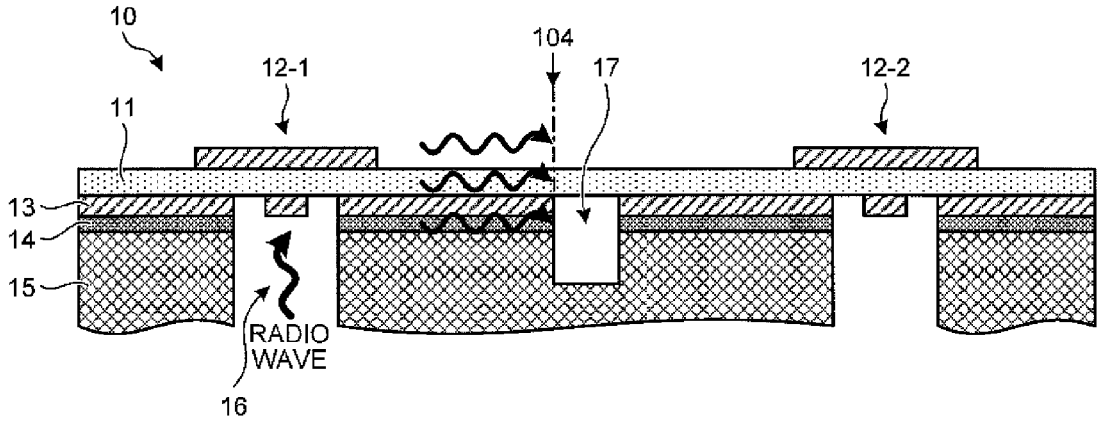
FIG. 1B is a view illustrating a schematic of a radio wave interference prevention technique according to the embodiment.

First, an outline of the radio wave interference prevention technique according to the embodiment is described using FIG. 1A and FIG. 1B. FIG. 1A is a rough schematic cross sectional view of an antenna device 10' according to the prior art. FIG. 1B is a view illustrating an outline of the radio wave interference prevention technique according to the embodiment.

As illustrated in FIG. 1A, the antenna device 10' according to the prior art includes a dielectric substrate 11. The dielectric substrate 11 is formed using an insulative resin material or the like. The dielectric substrate 11 is an example of a dielectric means.

Further, an antenna 12 is provided on the top surface side of the dielectric substrate 11. Two antennas, that is, a first antenna 12-1 and a second antenna 12-2 are provided in parallel as antennas 12. Further, a ground 13 is provided in the bottom surface side of the dielectric substrate 11.

Each of the antenna 12 and the ground 13 is formed as a thin film pattern of a conductive metal. The thin film pattern is formed by forming a thin film of copper or the like on the entire surface of the dielectric substrate 11 using a technique such as sputtering and vacuum evaporation followed by patterning of the thin film using photo etching or the like.

Further, the antenna device 10' includes a housing 15 which acts as a waveguide. The housing 15 is an example of a waveguide means. The housing 15 is a block of conductive material, for example, a rectangular parallelepiped block formed by the aluminum die-casting and has a hollow portion 16.

As illustrated in FIG. 1A, the top surface of the housing 15 is bonded to the bottom surface of the dielectric substrate 11 via a binder such as an adhesive sheet 14. The radio wave is radiated or enters via the hollow portion 16 and the antenna 12.

In each drawing used for the description, a rough schematic cross sectional view, as illustrated in FIG. 1A, is frequently shown. In every rough schematic cross sectional views, the illustrated figure magnified along the vertical direction to some extent. Therefore, the rough schematic cross sectional view illustrated in each of the drawings including FIG. 1A does not limit the relative thickness of the dielectric substrate 11, the antenna 12, the ground 13, the adhesive sheet 14, and the like.

It is assumed that, for example, the radio wave is radiated from the first antenna 12-1 as illustrated in FIG. 1A. As for the antenna device 10' according to the prior art, in this case, the radio wave propagates via a space, the dielectric substrate 11, and the adhesive sheet 14 toward the neighboring second antenna 12-2 (see the arrows 101 to 103 in each drawing).

Therefore, the radio wave interference is likely to occur between the neighboring antennas 12, which causes a distortion in the amplitude or the phase of the radio wave. In other words, the isolation between the neighboring antennas 12 is deteriorated.

In the radio wave interference prevention technique according to the embodiment, an interference prevention unit which is a mechanism for preventing the radio wave interference is provided between the neighboring antennas 12. The interference prevention unit is an example of an interference prevention means.

Specifically, in the radio wave interference prevention technique according to the embodiment, an interference prevention unit, for example, a hollow-structured groove (hollow groove 17), is provided between the neighboring antennas 12, as illustrated in FIG. 1B.

In other words, the antenna device 10 to which the radio wave interference prevention technique according to the embodiment is applied includes the hollow groove 17 formed so as to communicate slits provided on the ground 13 and the adhesive sheet 14, respectively, and a groove formed on the housing 15.

By providing the hollow groove 17 to the antenna device 10, the radio wave propagating via the space, the dielectric substrate 11, and the adhesive sheet 14 can be cut off at the edge of the hollow groove 17 (see the arrow 104 in the drawing). Detail of the structure and the effect of the hollow groove 17 will specifically be described using FIG. 2 and the following drawings.

As described above, by using the radio wave interference prevention technique according to the embodiment, the radio wave interference occurring between the neighboring antennas 12 can be prevented. Thereby, the isolation of the antenna 12 can be kept in preferable condition without causing a distortion in the amplitude or the phase of the radio wave.

Now, the exemplary structure of the first embodiment in which the hollow groove 17 illustrated in FIG. 1B is included will be described in detail.

The First Embodiment

Figure 2:
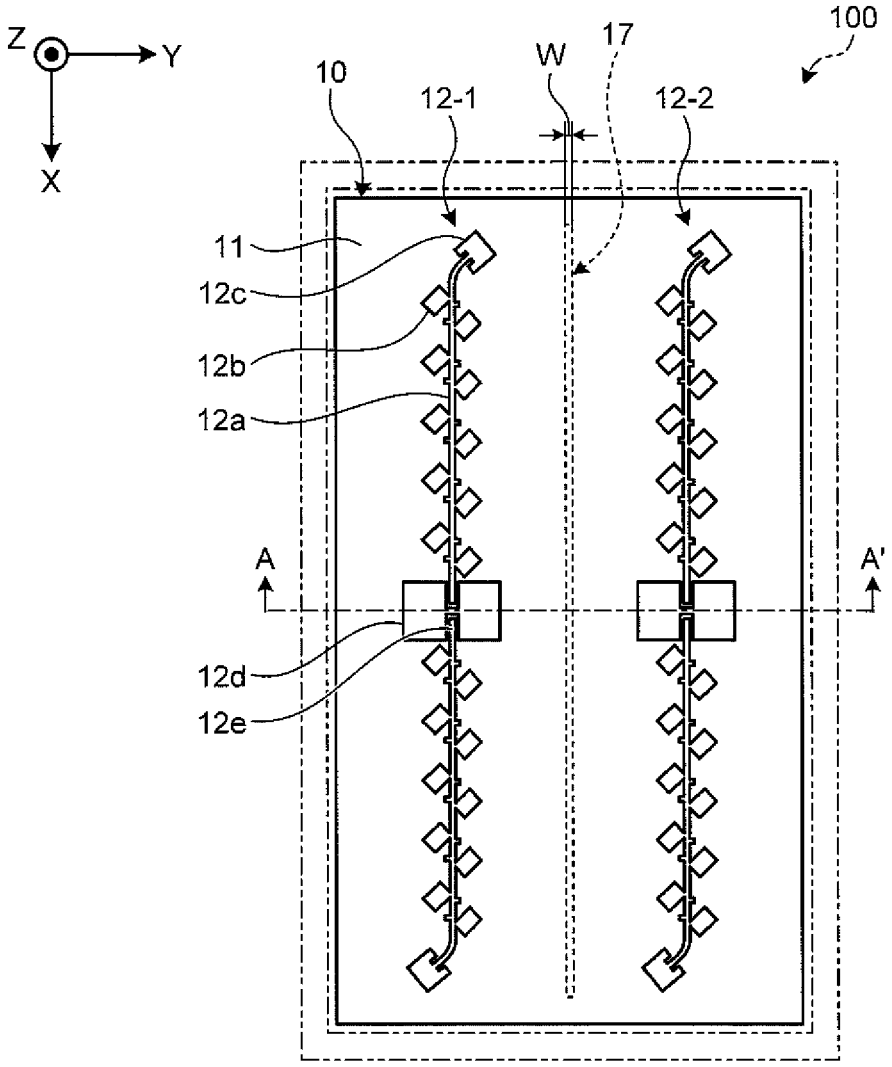
FIG. 2 is a schematic plan view illustrating a configuration of an antenna device according to a first embodiment.

FIG. 2 is a schematic plan view illustrating a structure of an antenna device 10 according to the first embodiment. For the ease of understanding of the description, a three dimensional orthogonal coordinate system including the Z-axis of which the positive direction is identical to the vertically upward direction is illustrated in FIG. 2. The orthogonal coordinate system is illustrated in some other drawings used in the following description.

Further in the description below, for a component constituted of a plurality of elements, only a portion of the plurality of elements may be appended with numerals, and the numerals for the other portions of the plurality of elements may be omitted. In such case, a portion appended with numerals and the other portions without numerals have a similar configuration.

Further in the description below, the description may be omitted or shortened for a component of which description duplicates with the description on the antenna device 10' illustrated in FIG. 1A.

As illustrated in FIG. 2, the antenna device 10 includes the dielectric substrate 11. As a base material of the dielectric substrate 11, for example, a fluoro-resin such as PTFE (Poly-Tetra-Fluoro-Ethylene), LCP (Liquid Crystal Polymer), or the like may preferably be used. Further, the first antenna 12-1 and the second antenna 12-2 are provided on the top surface side of the dielectric substrate 11 as the thin film pattern as described above.

As illustrated in FIG. 2, the antennas 12 are arranged in parallel so as to be approximately parallel along the longitudinal-axial direction of the antenna device 10 (see the X-axis direction in the drawing).

In the antenna 12, a linear array is formed by a linearly extending feedline 12*a* and a plurality of radiating elements 12*b* which is branched from the feedline 12*a* and excited at a same phase as that of the feedline 12*a*.

The feedline 12*a* is a microstrip line of which end is connected to a converter 12*d* via a feeding terminal 12*e*. A terminal end element 12*c* for restraining reflection is formed in the other end of the feedline 12*a*. Further, the radiating element 12*b* has a shape of an approximately squared shape which extends in the direction which intersects with the feedline 12*a* at a given angle.

The converter 12*d* is provided in the portion corresponding to the hollow portion 16 as described above, and mutually converts the transmission powers of the housing 15 and the feeding terminal 12*e*, via an exciter element 18 which will be described later.

The antenna device 10 further includes the hollow groove 17 as the interference prevention unit. The hollow groove 17 is linearly provided in an approximately middle location between the antennas 12, and to be approximately parallel to the antenna 12. In the description below, it is assumed that the hollow groove 17 is formed to have width W as illustrated in FIG. 2.

Further, the antenna device 10 is installed in, for example, a radar device 100. Here, the antenna device 10 is assumed to be installed in the radar device 100, and its internal structure will be described.

Figure 3A:
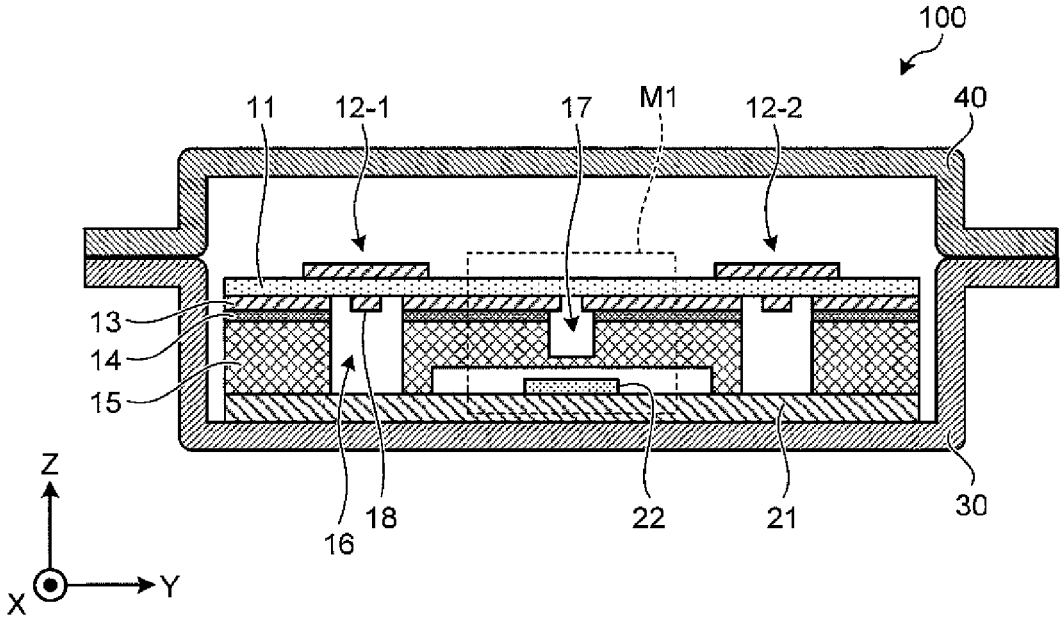
FIG. 3A is a rough cross sectional view taken along the line A-A' in FIG. 2.

FIG. 3A is a rough schematic cross sectional view taken along the line A-A' in FIG. 2. As described above and as illustrated in FIG. 3A, the bottom surface side, including the ground 13, of the dielectric substrate 11 is bonded to the top surface side of the housing 15 via the adhesive sheet 14.

Further, the exciter element 18 is provided on the bottom surface of the dielectric substrate 11 in a portion corresponding to the hollow portion 16. The exciter element 18 receives a radio wave from the hollow portion 16 and transmits to the antenna 12 (the first antenna 12-1 in the drawing).

Further, the bottom surface side of the housing 15 is bonded to a integrated circuit substrate 21. The integrated circuit substrate 21 includes a monolithic microwave integrated circuit, so-called a MMIC (Monolithic Microwave Integrated Circuit) 22, which performs signal processing such as oscillation, amplification, modulation, and frequency conversion of the microwave signal.

In this manner, the antenna 12 and the MMIC 22 are connected by waveguide connection via the housing 15. The integrated circuit substrate 21 is contained in a casing 30 of which top portion is covered by a covering member, that is, a radome 40, and in this manner, the radar device 100 is constituted.

Further, as illustrated in FIG. 3A, the hollow groove 17 is provided between the neighboring antennas 12 in the embodiment. Now, a detailed description will be made for the hollow groove 17.

Figure 3B:
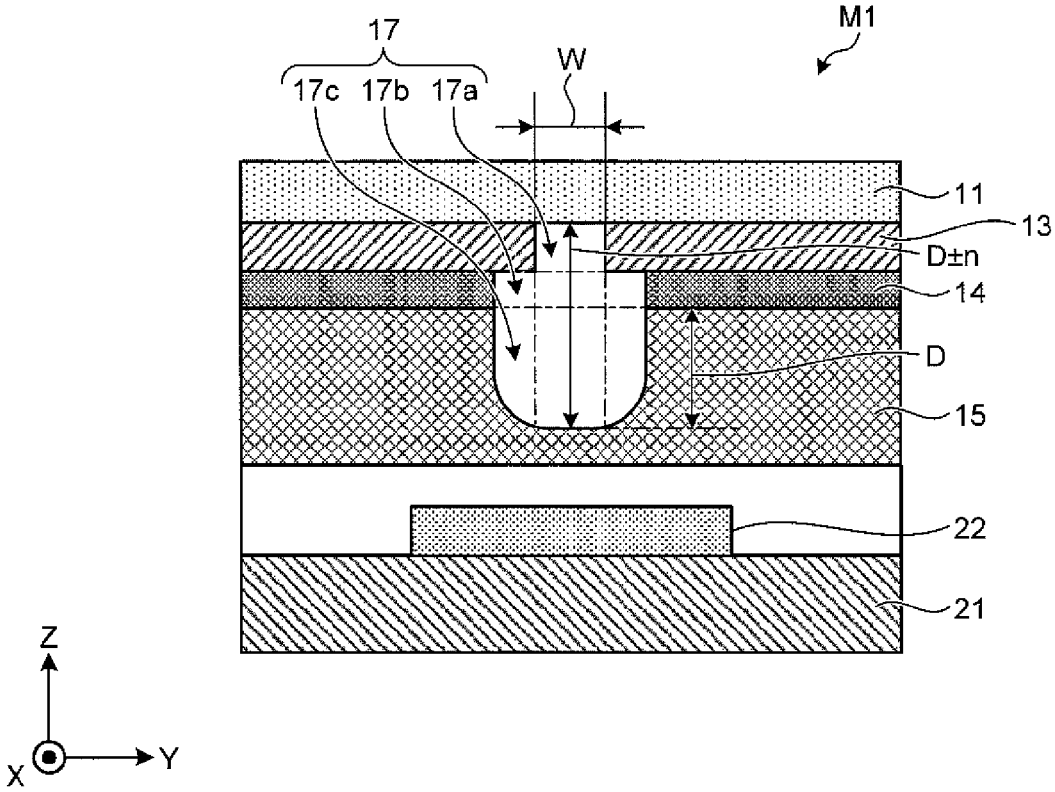
FIG. 3B is an enlarged view of the portion M1 in FIG. 3A.

FIG. 33 is an enlarged view of the portion M1 illustrated in FIG. 3A. As illustrated in FIG. 3B, the hollow groove 17 is formed by communicating a slit 17*a* provided so as to penetrate the ground 13, a slit 17*b* provided so as to penetrate the adhesive sheet 14, and a groove 17*c* formed on the top surface side of the housing 15.

Since the housing 15 is formed by, for example, aluminum die-casting, an R shape is often formed on the edge of the bottom portion of the groove 17*c* as illustrated in FIG. 3B. Thereupon, the width W (see also FIG. 2) of the hollow groove 17, that is, the width of the slit 17*a* provided on the ground 13, may at least correspond to the bottom width of the groove 17*c*.

Further, a depth D of the groove 17*c* may preferably have a dimension corresponding to about a quarter wavelength of the guide wavelength of the radio wave of which frequency is used in the antenna device 10. Therefore, the overall depth of the hollow groove 17 is D±n, that is, the depth D having a dimension of about a quarter wavelength added or subtracted with the allowable difference n including thicknesses and geometrical tolerances of the ground 13 and the adhesive sheet 14.

Figure 4:
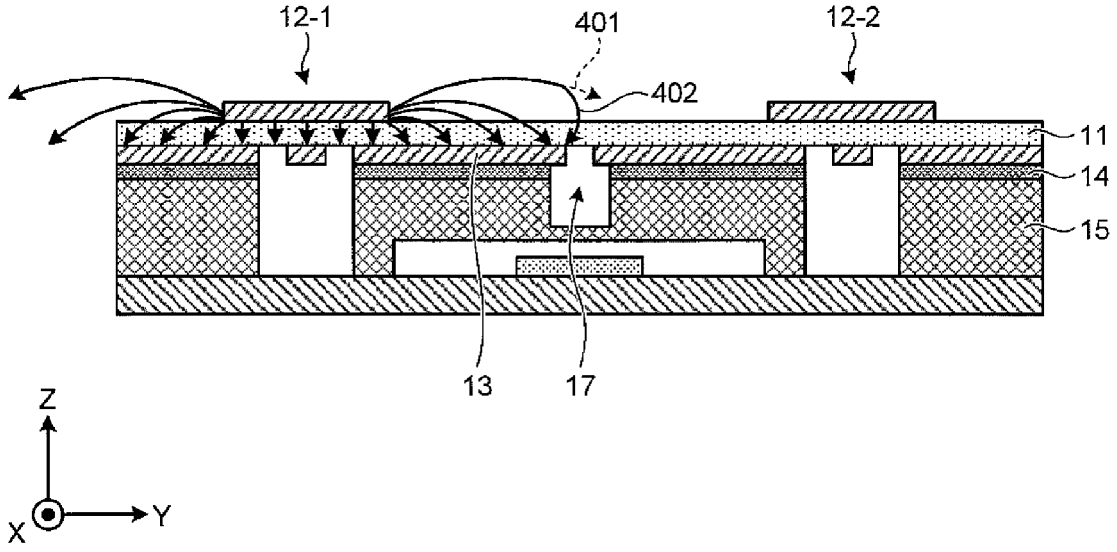
FIG. 4 is a schematic view illustrating an electric line of force from an antenna.

The effect of forming the hollow groove 17 in the manner described above will be described using FIG. 4 to FIG. 6. FIG. 4 is a schematic view illustrating an electric line of force from the antenna 12. In FIG. 4, an electric line of force from the second antenna 12-2 is omitted. The electric line of force from the second antenna 12-2 is assumed to be somewhat different in the horizontal direction from the electric line of force from the first antenna 12-1.

As illustrated in FIG. 4, by providing the hollow groove 17, the electric line of force which originally runs in the direction toward the second antenna 12-2 from an initial point, that is, the first antenna 12-1 (see the arrow 401 in the drawing) is distorted toward the end portion of the hollow groove 17, more specifically, toward the end portion of the ground 13 (see the arrow 402 in the drawing).

That is, the radio wave propagating the space from the first antenna 12-1 toward the second antenna 12-2 can be cut off at the end portion of the hollow groove 17. Thereby, the radio wave interference between the neighboring antennas 12 is restrained so that the isolation between the antennas 12 can be improved.

Figure 5A:
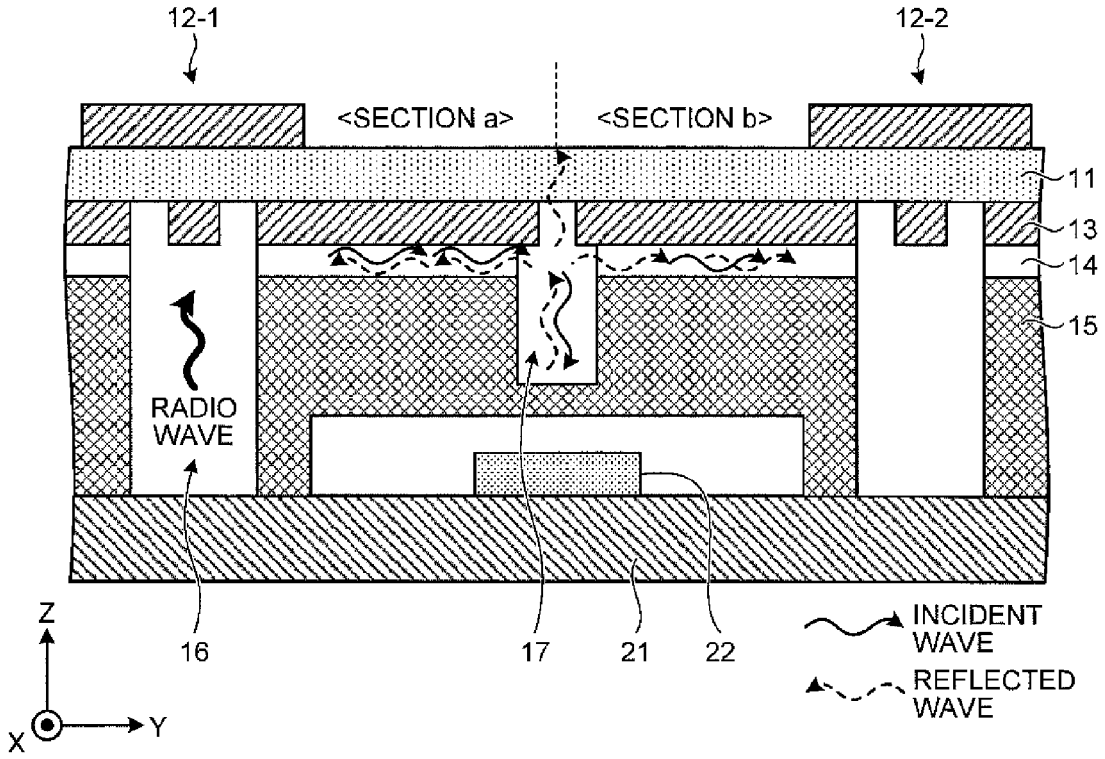
FIG. 5A to FIG. 5C are explanation views part 1 to part 3 of wavelength propagation in an adhesive sheet.
Figure 5B:
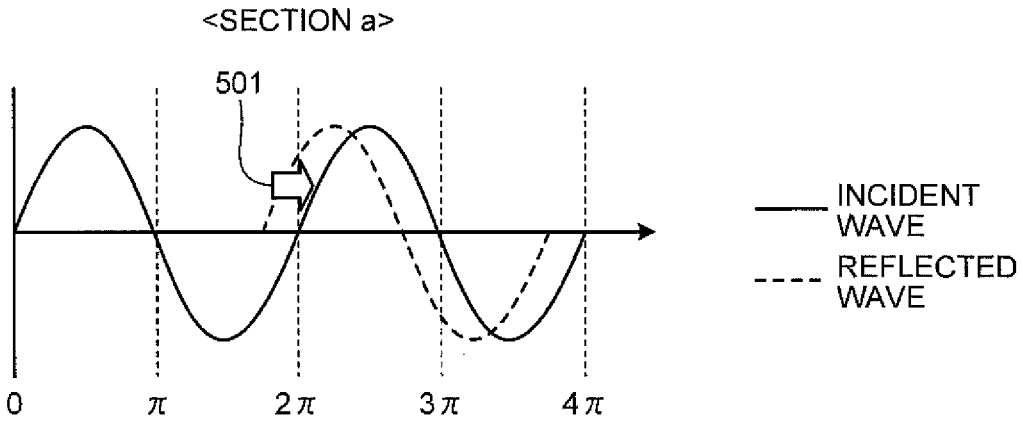
Figure 5C:
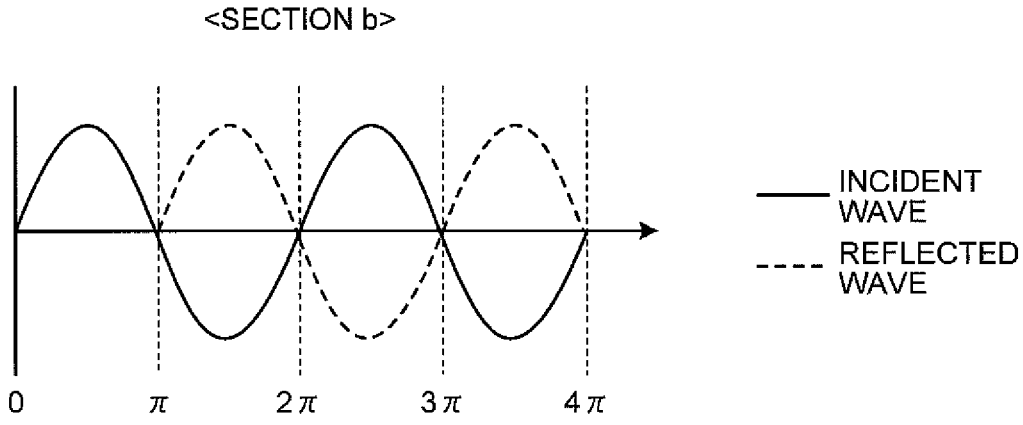

Now, FIG. 5A to FIG. 5C are explanation views part 1 to part 3 of the wavelength propagation in the adhesive sheet 14. The hatching of the adhesive sheet 14 is omitted in FIG. 5A for the ease of understanding.

Further, for the convenience of explanation in FIG. 5A, the section is divided in two sections with the hollow groove 17 in the center. The section including the first antenna 12-1 is defined as "section a", and the other section including the second antenna 12-2 is defined as "section b".

As illustrated in FIG. 5A, it is assumed that the radio wave is radiated from the first antenna 12-1 via the hollow portion 16 of the housing 15. And the radio wave which propagates in the adhesive sheet 14 firstly propagates through section a in the positive direction of the Y-axis shown in the drawing as an incident wave.

Then the incident wave propagates into the hollow groove 17. An incident wave which propagates toward the bottom portion of the hollow groove 17 reflects at the bottom portion. If the depth D of the groove 17*c* (see FIG. 3B) has a dimension of a quarter of the wavelength, and with effect of the dielectric constant of the space inside the hollow groove 17, the wave reflected at the bottom portion becomes a reflected wave having, at the bottom portion of the groove 17*c*, a phase different from that of the incident wave by π.

When the reflected wave having the phase difference of n progresses the same depth D in the returning path and reflects, an additional phase difference of π is produced. Therefore, as illustrated in FIG. 5B, the reflected wave which propagates in section a toward the negative direction of the Y-axis illustrated in the drawing has a phase different from that of the incident wave by 2π, that is, a phase same as that of the incident wave. The arrow 501 in FIG. 5B schematically illustrates that, in section a, the phase of the reflected wave changes by 2π, thereby becoming same as the phase of the incident wave.

Contrary, the phase difference between the incident wave which enters from section a into section b and the reflected wave which propagates toward section b after the reflection at the bottom portion of the hollow groove 17 is n as illustrated in FIG. 5C. This is due to the difference between the incident wave which, while being affected by the dielectric constant of the space inside the hollow groove 17, enters directly from section a into section b passing through the hollow groove 17, and the reflected wave which propagates back and forth within the depth D described above.

That is, the width of the slit 17*b* provided on the adhesive sheet 14 (see FIG. 3B) is provided so as that the phase difference between the incident wave and the reflected wave in section b is n corresponding to the depth D or the depth D±n.

Consequently, in section b, the incident wave and the reflected wave have phases opposite to, and thereby canceling, each other, by which the radio wave from the first antenna 12-1 does not propagate toward the second antenna 12-2.

In this manner, the radio wave which propagates in the adhesive sheet 14 from the first antenna 12-1 toward the second antenna 12-2 can be cut off by the hollow groove 17. That is, the radio wave interference between the neighboring antennas 12 is restrained and the isolation between the antennas 12 can be improved.

The radio wave propagating in the dielectric substrate 11 can be cut off by the similar principle, although the description will be omitted. Therefore, as for the dielectric substrate 11, the propagating radio wave can be cut off to restrain the radio wave interference by providing the hollow groove 17, and the isolation between the antennas 12 can be improved.

Figure 6:
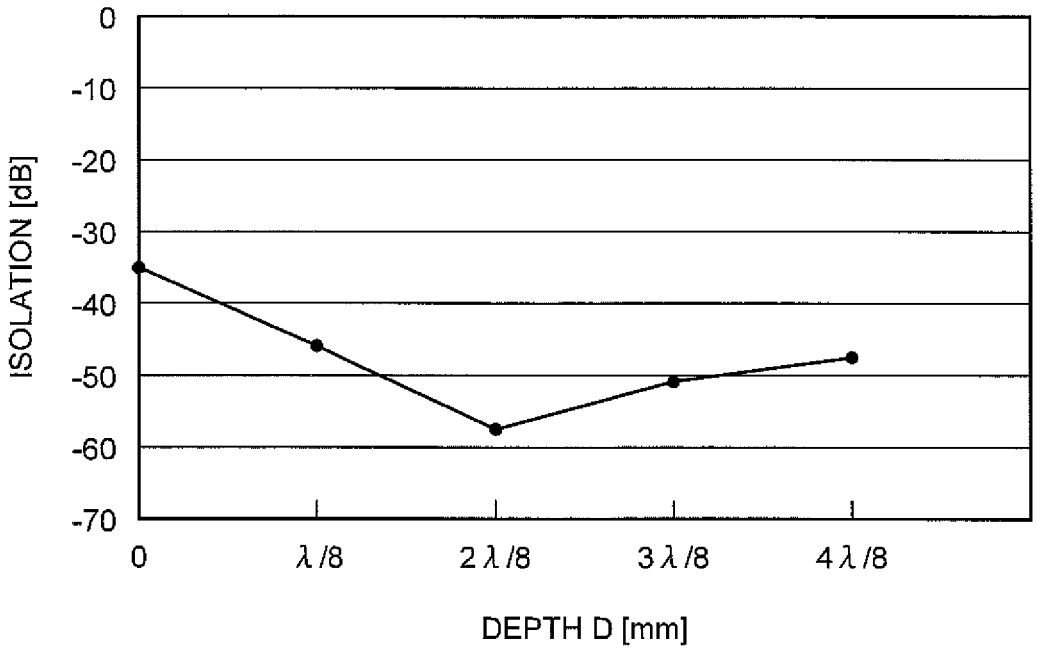
FIG. 6 is a view illustrating a relation between a depth of a groove and isolation between antennas.

The relation between the depth D and the isolation between the antennas 12, which is obtained by actually simulating the first embodiment, is illustrated in FIG. 6. FIG. 6 is a view illustrating the relation between the depth D of the groove 17*c* and the isolation between antennas 12. Here, λ represents a wavelength.

As illustrated in FIG. 6, it can firstly be understood that the degree of isolation for cases other than the case for the depth D=0 are improved compared to the case for the depth D=0. That is, isolation can surely be improved by providing the hollow groove 17, compared to the case in which the hollow groove 17 is not provided.

Further, as illustrated in FIG. 6, it can be understood that, among the cases in which the hollow groove 17 is provided, isolation can maximally be improved for the case in which the depth D is 2λ/8. Therefore, as described above, the depth D is preferable to be about a quarter of the wavelength.

Figure 7:
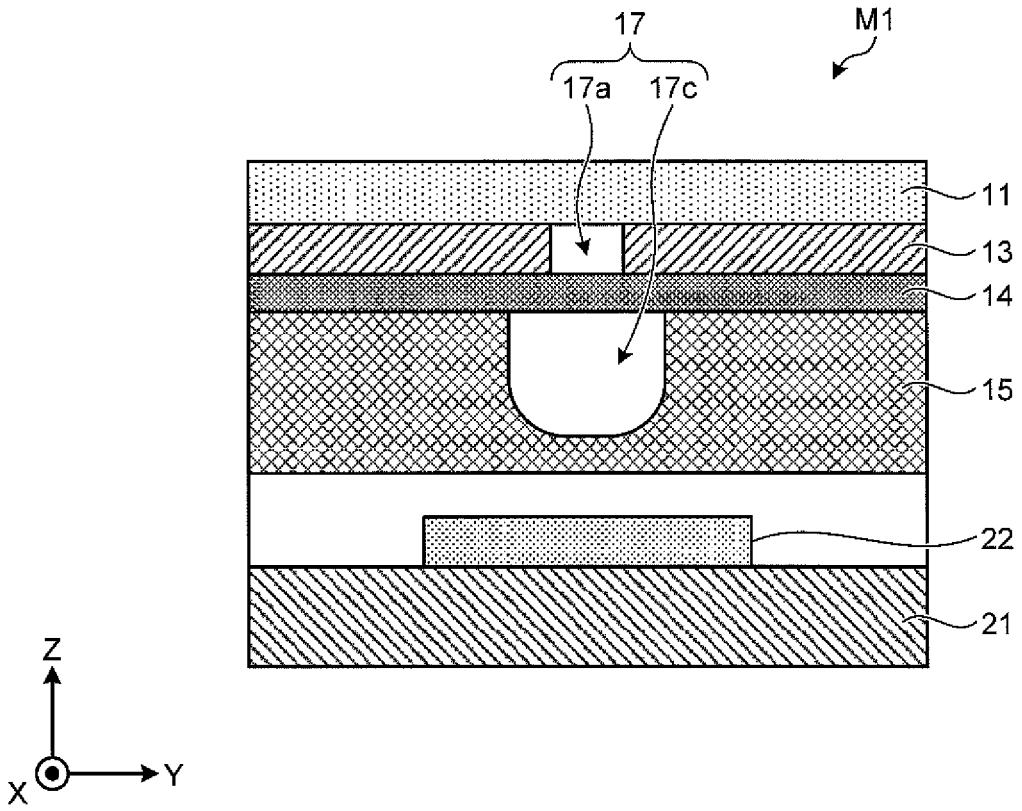
FIG. 7 is a rough schematic cross sectional view illustrating a first exemplary variation of a hollow groove.

Now, an exemplary variation of the hollow groove 17 will be described using FIG. 7 and FIG. 8. FIG. 7 is a rough schematic cross sectional view illustrating a first exemplary variation of the hollow groove 17. FIG. 7 corresponds to an enlarged view of the portion M1 already illustrated in FIG. 3B.

Figure 8:
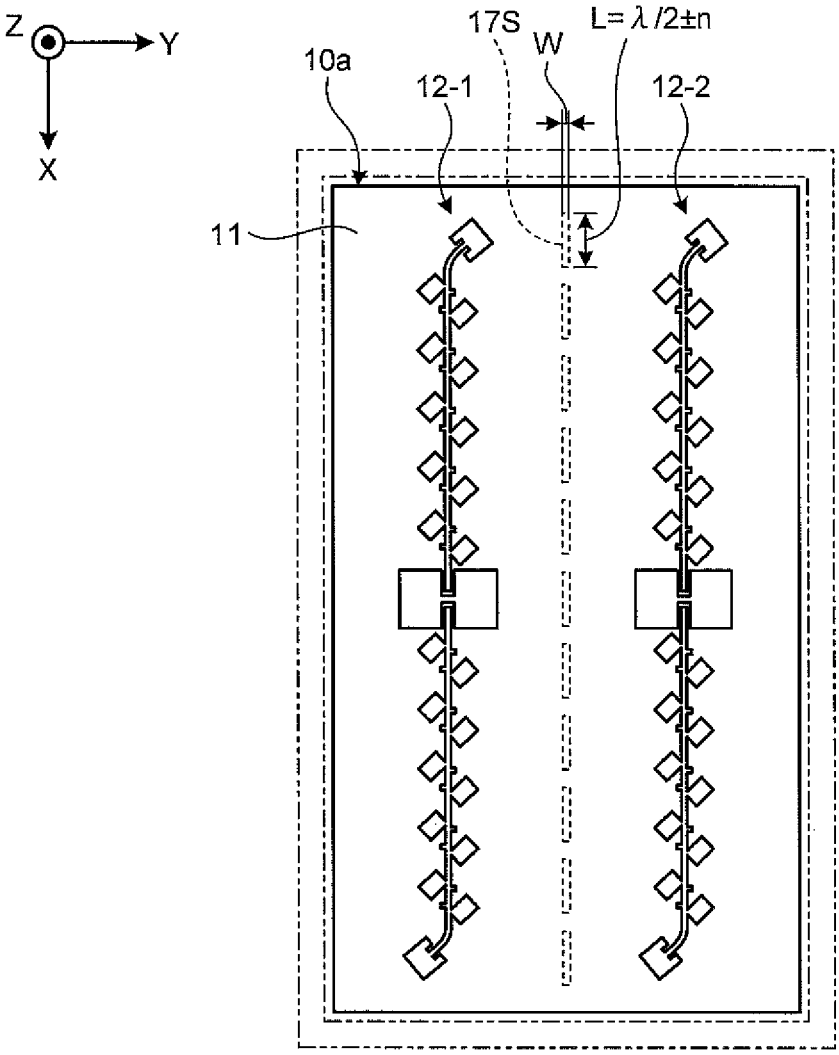
FIG. 8 is a schematic plan view illustrating a second exemplary variation of a hollow groove.

FIG. 8 is a schematic plan view illustrating a second exemplary variation of the hollow groove 17. FIG. 8 corresponds to FIG. 2 already illustrated. In FIG. 8, the antenna device is appended with the numeral "10*a*".

First Exemplary Variation of Hollow Groove

As illustrated in FIG. 7, the hollow groove 17 may be parted in two sections by the adhesive sheet 14. That is, the hollow groove 17 may be configured with the slit 17*a* provided on the ground 13 and the groove 17*c* provided on the housing 15, without processing the adhesive sheet 14.

Although the thickness of the adhesive sheet 14 illustrated in FIG. 7 is magnified in the Z-axis direction, the actual thickness is extremely as small as 100 μm. Therefore, even if the hollow groove 17 is parted in two stages as in this manner by the adhesive sheet 14, the prevention of the radio wave interference as described above can effectively be provided for a certain degree.

Further, the adhesive sheet 14 need not be processed, which contributes to improving efficiency of the manufacturing process.

Second Exemplary Variation of Hollow Groove

Further, as illustrated in FIG. 8, the hollow groove 17 may be provided as a slit 17S which is formed by dividing the slit 17*a* (see FIG. 3B or FIG. 7) provided on the ground 13 so as the slit 17S to have a given length L in the longitudinal axial direction of the antenna 10*a*.

The width W and the length L of the slit 17S should have, at least, the relation of W<L. Further, as illustrated in FIG. 8, the length L is preferably be of a value expressed by L=λ/2±n, where "λ" is the wavelength and "n" is the allowable difference as described above.

As described above, by providing the divided slit 17S on the ground 13, the radiant quantity of the radio wave radiated from the slit 17S can be increased. That is, the radio wave interference between the antennas 12 can be restrained, which contributes to improving the isolation between the antennas 12.

As described above, in the first embodiment, the antenna device including the dielectric substrate, the housing, and the interference prevention unit is constituted. On the top side of the dielectric substrate, a plurality of antennas is formed, and on the bottom side, the ground is formed, each as a conductive thin film pattern.

The housing is formed of a conductive material and in a shape which acts as a waveguide. The top side of the housing is bonded to the bottom side of the dielectric substrate. The interference prevention unit is provided between the neighboring antennas.

Further, the interference prevention unit is formed to include, at least, a groove provided on the top surface side of the housing and a slit provided on the ground in the portion corresponding to the groove.

Therefore, by using the antenna device and the radar device using the antenna device according to the first embodiment, the radio wave interference occurring between the neighboring antennas can be prevented.

In the first embodiment described above, the description is made for the case in which the hollow groove is provided between the neighboring antennas as an interference prevention unit, though an opening may additionally be provided on the dielectric substrate between the antennas. Such case will be described as the second embodiment using FIG. 9A to FIG. 9C.

Second Embodiment

Figure 9A:
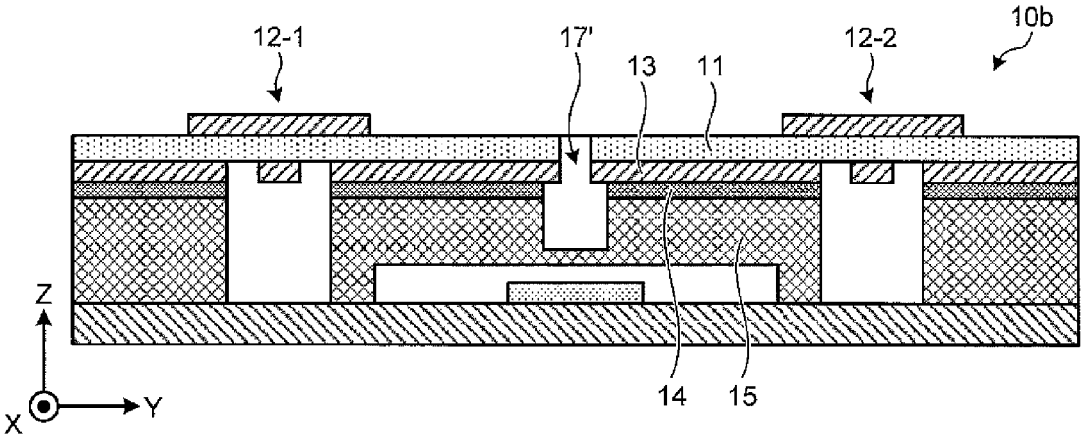
FIG. 9A is a rough schematic cross sectional view illustrating a configuration of an antenna device according to a second embodiment.

FIG. 9A is a rough schematic cross sectional view illustrating a configuration of an antenna device 10*b* according to the second embodiment. FIG. 9B and FIG. 9C are rough schematic cross sectional views part 1 and part 2 illustrating an exemplary variation of the second embodiment.

Figure 9B:
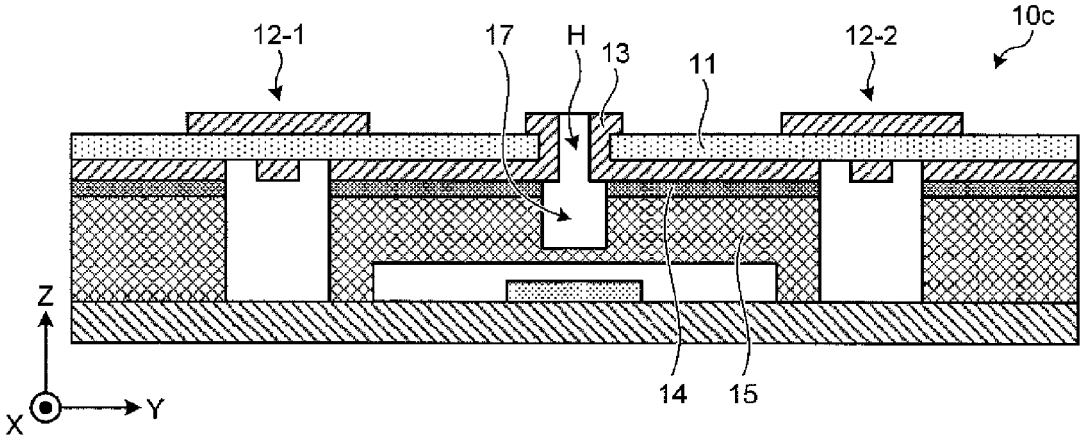
FIG. 9B and FIG. 9C is a rough schematic cross sectional views part 1 and part 2 illustrating an exemplary variation of the second embodiment.
Figure 9C:
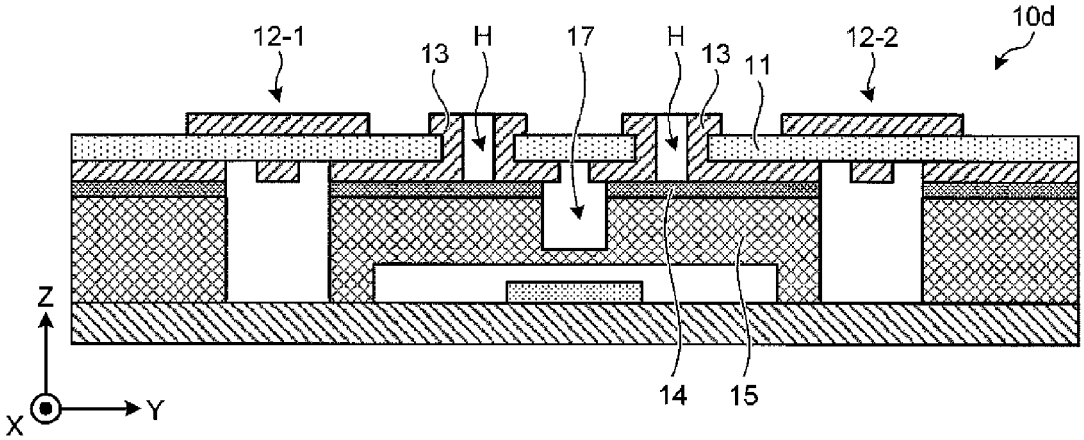

In FIG. 9B and FIG. 9C, the numerals "10*c*" and "10*d*" are appended to the antenna devices, respectively. In the second embodiment, the description of the component which duplicates with the description made for the component of the first embodiment may be omitted or simplified.

As illustrated in FIG. 9A, the antenna device 10*b* includes a groove 17' as an interference prevention unit between the neighboring antennas 12. The groove 17' is provided by providing an opening on the portion corresponding to the hollow groove 17 of the dielectric substrate 11 (see the first embodiment) so as to communicate the dielectric substrate 11 with the hollow groove 17.

As in the manner described above, by providing a communication from the housing 15 through the dielectric substrate 11 and providing the groove 17' opened on the dielectric substrate 11, the radio wave propagating in the dielectric substrate 11 and the adhesive sheet 14 can efficiently be radiated from the opening, thereby contributing to the prevention of the radio wave interference.

First Exemplary Variation of Second Embodiment

Further, as illustrated in FIG. 9B, a through hole H which is communicated with the ground 13 may be provided on the dielectric substrate 11. The through hole H may be communicated with the hollow groove 17.

In this manner, the electric line of force from the antenna 12 can surely be introduced in the direction toward the ground 13 on the dielectric substrate 11, thereby also contributing to the prevention of the radio wave interference. A plurality of such through holes H is preferably provided along the extending direction of the hollow groove 17 (i.e., the X-axis direction in the drawing). When the hole diameter of the through hole H is small, the through hole H introduces the electric line of force from the antenna 12 in the direction toward the ground 13 on the dielectric substrate 11. When the hole diameter of the through hole H is large, the through hole H introduces the electric line of force from the antenna 12 in the direction toward the ground 13 on the dielectric substrate 11, and allows unnecessary radio wave propagating in the dielectric substrate 11 and the adhesive sheet 14 to radiate outside from the through hole H. In the case when a plurality of through holes H is provided in the X-axis direction, each distance between through holes H may preferably be the distance corresponding to a quarter wavelength, or less, of the guide wavelength of the radio wave having a frequency used in the antenna device 10.

Second Exemplary Variation of Second Embodiment

Further, as illustrated in FIG. 9C, the through hole H may be provided without a communication with the hollow groove 17. Further, in this case, as illustrated in FIG. 9C, a plurality of through holes H may be provided in parallel along the Y-axis direction in the drawing, and further be provided in the X-axis direction similarly to FIG. 9B. The function of the through hole H with relation to the hole diameter is similar to that of the configuration in FIG. 9B. In the case when a plurality of through holes H is provided in the X-axis direction, a preferable distance between the through holes H is also similar to that of the configuration in FIG. 9B.

In this manner, when the hole diameter of the through hole H is small, the through hole H can introduce the electric line of force from the first antenna 12-1 and the second antenna 12-2 in the direction toward the ground 13 on the dielectric substrate 11, respectively. When the hole diameter of the through hole H is large, the through hole H allows the radio wave propagating from the first antenna 12-1 and the radio wave propagating from the second antenna 12-2 to radiate independently from the through hole H, which also restrains the radio wave interference and can thereby improve the isolation between the antennas 12.

That is, also by using the antenna device and the radar device using the antenna device according to the second embodiment, the radio wave interference occurring between the neighboring antennas can be prevented.

In the first embodiment described above, description is made for the case in which the slit is provided on the ground divided by a given length in the longitudinal axial direction of the antenna device (see FIG. 8). The provided slit can further incline against the longitudinal axial direction. Such case is referred to as the third embodiment, and will be described using FIG. 10A and FIG. 10B. Hereinafter, the divided slit will be referred to as a "slot".

The Third Embodiment

Figure 10A:
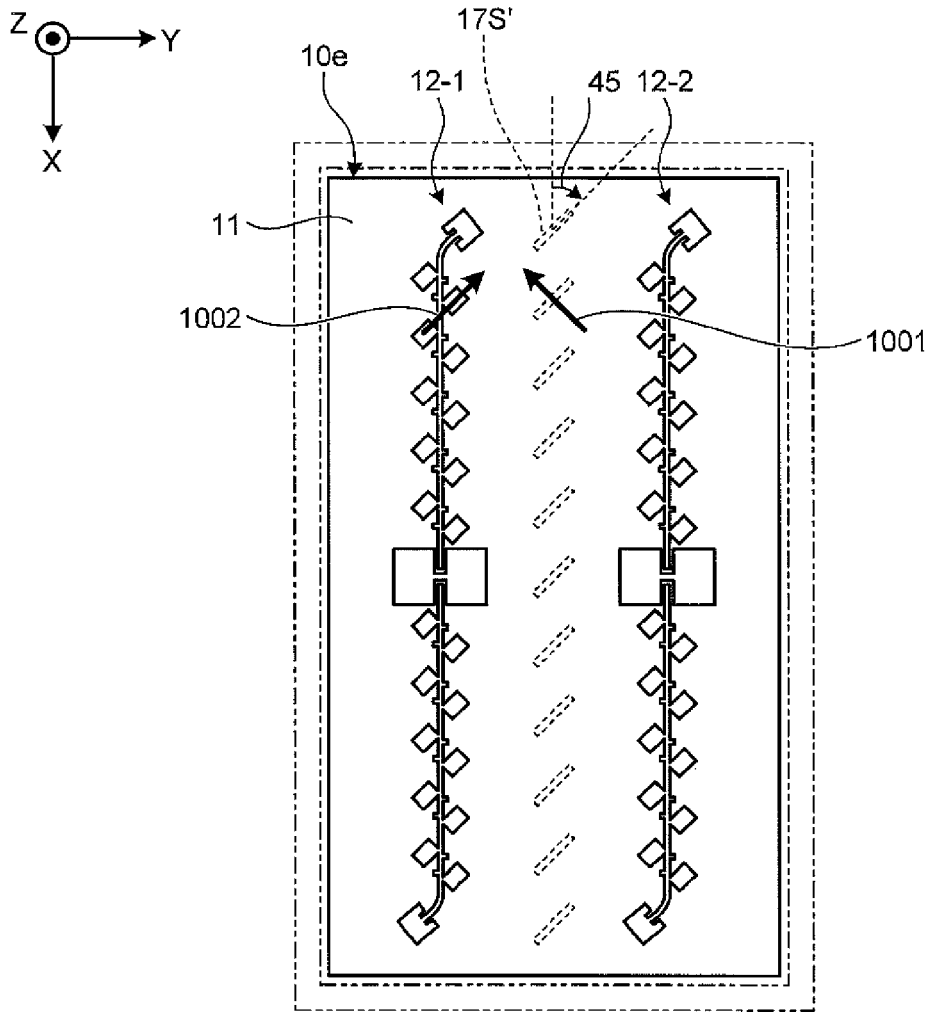
FIG. 10A is a schematic plan view illustrating a configuration of an antenna device according to a third embodiment.

FIG. 10A is a schematic plan view illustrating a configuration of an antenna device 10*e* according to the third embodiment. FIG. 10B is a drawing for supplementally explaining FIG. 10A.

As illustrated in FIG. 10A, the antenna device 10*e* includes a plurality of slots 17S'. The slot 17S' is provided, for example, to have a 45 degrees of inclination against the longitudinal axial direction (see the X-axis direction in the drawing) of the antenna device 10*e*. That is, the slots 17S' are in the arrangement in that each of the slits 17S already illustrated in FIG. 8 is rotated 45 degrees clockwise relative to the longitudinal axial direction.

In this manner, the polarization direction of the radio wave radiated from the slot 17S' can be shifted. The arrow 1001 illustrated in FIG. 10A and FIG. 10B is the polarization direction of the radio wave from the slot 17S'. Similarly, the arrow 1002 is the polarization direction of the radio wave from the antenna 12. Specific description will be made using the arrows 1001 and 1002.

Figure 10B:
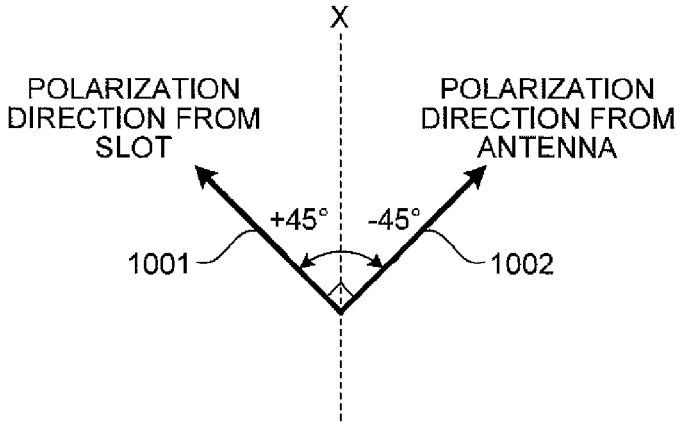
FIG. 10B is a supplementary explanation view of FIG. 10A.

By providing the slot 17S' with the inclination of 45 degrees as illustrated in FIG. 10A, the inclination of +45 degrees against the longitudinal axial direction (see the X-axis direction in the drawing) can be provided to the polarization direction from the slot 17S' as illustrated in FIG. 10B (see the arrow 1001 in the drawing).

The radiating element 12*b* of the antenna 12 is provided so as to extend in the direction which intersects with the feedline 12*a* at the inclination angle of 45 degrees, by which a 45 degrees of polarization is obtained. In this case, as illustrated in FIG. 10B, the polarization direction from the antenna 12 has an inclination of −45 degrees against the longitudinal axial direction (see the arrow 1002 in the drawing).

That is, as illustrated in FIG. 10B, the polarization direction from the antenna 12 and the polarization direction from the slot 17S' can be shifted relatively by 90 degrees. As described above, by providing the polarization direction from the antenna 12 and the polarization direction from the slot 17S' so as to intersect with each other at right angles, the interference between the radio wave from the antenna 12 and the radio wave from the slot 17S' can be reduced. Consequently, the radio wave interference between the antennas 12 is restrained, which contributes to improving the isolation between the antennas 12.

Description is made above for the example in which the slot 17S' has an inclination of 45 degrees, though it is not limited to the case. Any case may be carried out as long as an inclination can be provided to the slot 17S' so as to give the angle difference of 90 degrees relative to the corresponding polarization direction of the antenna 12, that is, the inclination provided to the radiating element 12*b*.

In this manner, also by using the antenna device and the radar device using the antenna device according to the third embodiment, the radio wave interference occurring between the neighboring antennas can be prevented.

For each of the embodiments described above, description is made, as an example, for the case in which the antenna is a microstrip antenna, though the antenna is not limited to the microstrip antenna.

For example, application may be made to a so-called triplate type planer antenna or the like in which a dielectric sheet such as a foam material is attached on each of the top and the bottom of a film substrate that is etched with a copper foil pattern, and the dielectric sheets are further attached with parallel plates on both the top and the bottom sides thereof.

Further, for each of the embodiments described above, description is made, as an example, for the case in which the antenna is in a form of a linear array, in which the linear arrays are arranged in parallel so as to be approximately parallel, though it is not limited to the case. That is, if a plurality of antennas neighboring each other is provided, each of the pattern shapes of the antennas is not a problem.

Further, for each of the embodiments described above, description is made, as an example, for the case in which the binder is an adhesive sheet, though it is not limited to the case. For example, an adhesive such as an epoxy resin based adhesive having a high insulating property may be used.

According to one aspect of the embodiment, the radio wave interference occurring between neighboring antennas can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna device comprising:

a dielectric substrate on which top surface side a plurality of antennas is formed and on which bottom surface side a ground is formed, each as a conductive thin film pattern, respectively;

a housing which is formed of a conductive material and formed to have a shape configured to function as a waveguide, and configured that a top surface side thereof is bonded to a bottom surface side of the dielectric substrate; and an interference prevention unit which is formed between the neighboring antennas to include a groove provided on a top surface side of the housing, and a slit provided in a portion of the ground, which portion corresponding to the groove in an area which is different from an area having the shape configured to function as the waveguide of the housing.

2. The antenna device according to claim 1, wherein the housing is bonded to the dielectric substrate via a conductive binder.

3. The antenna device according to claim 2, wherein the interference prevention unit is formed as a hollow groove formed by continuously stacking the groove of the housing, a slit provided on the binder, and the slit provided in the portion of the ground.

4. The antenna device according to claim 2, wherein the interference prevention unit is formed as a plurality of hollow grooves in which the groove of the housing and the slit of the ground are divided in two stages by the binder.

5. The antenna device according to claim 3, wherein the hollow groove has a depth in which a quarter wavelength is added or subtracted with a difference including a thickness of the ground and the binder.

6. The antenna device according to claim 4, wherein the hollow groove has a depth in which a quarter wavelength is added or subtracted with a difference including a thickness of the ground and the binder.

7. The antenna device according to claim 1, wherein the slit of the ground at least has a width corresponding to a bottom width of the groove.

8. The antenna device according to claim 2, wherein the slit of the ground at least has a width corresponding to a bottom width of the groove.

9. The antenna device according to claim 3, wherein the slit of the ground at least has a width corresponding to a bottom width of the groove.

10. The antenna device according to claim 4, wherein the slit of the ground at least has a width corresponding to a bottom width of the groove.

11. The antenna device according to claim 5 wherein the slit of the ground at least has a width corresponding to a bottom width of the groove.

12. The antenna device according to claim 6 wherein the slit of the ground at least has a width corresponding to a bottom width of the groove.

13. The antenna device according to claim 3, wherein:

the antenna has a form of a linear array of a microstrip antenna, in which the linear arrays are arranged in parallel so as to be approximately parallel to each other; and the hollow groove is linearly provided at a location which is approximately in a middle between the antennas and to be approximately parallel to the antenna.

14. The antenna device according to claim 4, wherein:

the antenna has a form of a linear array of a microstrip antenna, in which the linear arrays are arranged in parallel so as to be approximately parallel to each other; and the hollow groove is linearly provided at a location which is approximately in a middle between the antennas and to be approximately parallel to the antenna.

15. The antenna device according to claim 5, wherein the slit of the ground is divided in a plurality of portions, each portion having a length, in an longitudinal axial direction, in which a half wavelength is added or subtracted with the difference.

16. The antenna device according to claim 6, wherein the slit of the ground is divided in a plurality of portions, each portion having a length, in an longitudinal axial direction, in which a half wavelength is added or subtracted with the difference.

17. A radar device comprising:

the antenna device according to claim 1;

an integrated circuit substrate including a microwave integrated circuit and bonded to the housing;

a casing containing the integrated circuit substrate; and a radome which is a covering member for covering a top portion of the casing.

18. An antenna device comprising:

a dielectric means on which top surface side a plurality of antennas is formed, and on which bottom surface side a ground is formed, each as a conductive thin film pattern, respectively;

a waveguide means which is formed of a conductive material and formed to have a shape configured to function as a waveguide, and configured that a top surface side thereof is bonded to a bottom surface side of the dielectric means; and an interference prevention means which is formed between the neighboring antennas to include a groove provided on a top surface side of the waveguide means and a slit provided on the ground in a portion corresponding to the groove in an area which is different from an area having the shape configured to function as the waveguide of the housing.

* * * * *